United States Patent [19]

Uchino et al.

[11] 4,109,627

[45] Aug. 29, 1978

[54] TWO-SPEED FUEL INJECTION PUMP GOVERNOR

[75] Inventors: Mitsuo Uchino; Seizi Takahashi, both of Higashi Matsuyama, Japan

[73] Assignee: Diesel Kiki Co., Ltd., Tokyo, Japan

[21] Appl. No.: 738,206

[22] Filed: Nov. 3, 1976

[30] Foreign Application Priority Data

Nov. 5, 1975 [JP] Japan ..... 50-150823[U]

[51] Int. Cl.[2] ..... F02D 1/04

[52] U.S. Cl. ..... 123/140 R; 123/140 J; 123/140 MC

[58] Field of Search ..... 123/140 R, 140 MC, 140 J

[56] References Cited

U.S. PATENT DOCUMENTS

| | | | |
|---|---|---|---|
| 3,530,845 | 9/1970 | Staudt et al. | 123/140 R |
| 3,797,470 | 3/1974 | Beck | 123/140 R |
| 3,884,205 | 5/1975 | Staudt et al. | 123/140 R |
| 3,884,206 | 5/1975 | Ritter | 123/140 R |
| 3,923,025 | 12/1975 | Isobe et al. | 123/140 J |
| 3,946,715 | 3/1976 | Staudt | 123/140 R |
| 4,000,728 | 1/1977 | Kurokawa | 123/140 R |

FOREIGN PATENT DOCUMENTS

| | | | |
|---|---|---|---|
| 764,070 | 12/1956 | United Kingdom | 123/140 R |

*Primary Examiner*—Charles J. Myhre
*Assistant Examiner*—Parshotam S. Lall
*Attorney, Agent, or Firm*—Frank J. Jordan

[57] ABSTRACT

Flyweights develop sufficient centrifugal force to overcome the preload of a high speed governor spring when the speed of an internal combustion engine is above a predetermined maximum value to move a fuel control rod to decrease the amount of fuel injection and reduce the engine speed to the maximum value. The flyweights develop insufficient centrifugal force to overcome the preload of a low speed governor spring when the engine speed drops below a predetermined minimum value and the low speed governor spring moves the flyweights and thereby the fuel control rod to increase the amount of fuel injection and increase the engine speed to the minimum value. A manual speed control member moves the fuel control rod to control the engine speed between the minimum and maximum values. A linkage connects the speed control member to the flyweights in such a manner as to limit movement thereof when the engine speed is below the minimum value to a degree which is dependent on the position of the speed control member to prevent excessive fuel injection when the engine is operating under load.

12 Claims, 5 Drawing Figures

TWO-SPEED FUEL INJECTION PUMP GOVERNOR

BACKGROUND OF THE INVENTION

The present invention relates to a two-speed fuel injection pump governor especially suited to a compression ignition or Diesel engine.

In a known two-speed governor, the centrifugal force developed by flyweights is balanced against the forces of high and low speed governor springs. When the engine speed exceeds a predetermined maximum value, the flyweights overcome the preload of the high speed governor spring and move a fuel control rod to decrease the amount of fuel injection and reduce the engine speed to the maximum value. When the engine speed drops below a predetermined minimum value the flyweights and thereby the control rod are moved by the low speed governor spring to increase the amount of fuel injection and increase the engine speed to the minimum value. A manual speed control member such as an accelerator pedal moves the fuel control rod to control the engine speed between the minimum and maximum values in which case the engine speed depends on the position of the speed control member and the engine load.

The flyweights and low speed governor spring are designed to supply sufficient fuel into the engine to prevent stalling under no-load conditions. However, when the engine speed drops below the minimum value with the engine operating under load, a proportionately smaller amount of fuel injection increase is required to raise the engine speed to the minimum value. As a result, excessive fuel is injected during minimum speed regulation with the engine operating under load which results in incomplete combustion and the emission of pollutants into the atmosphere.

SUMMARY OF THE INVENTION

It is an object of the present invention to provide an improved two-speed fuel injection pump governor for an internal combustion engine in which the problem of excessive fuel injection during low speed regulation with the engine operating under load is eliminated.

It is another object of the present invention to provide a fuel injection pump governor in which the amount of fuel injection increase during low speed regulation is reduced in proportion to the engine load.

It is another object of the invention to provide a fuel injection pump governor comprising a linkage which modifies the operation of a flyweight assembly in accordance with the position of a speed control member.

It is another object of the invention to provide a fuel injection pump governor which progressively limits movement of flyweights in a fuel injection increasing direction as a speed control member is moved toward a maximum speed demand position.

It is another object of the invention to provide a fuel injection pump governor which supplies the correct amount of fuel into an internal combustion engine under all speed and load conditions.

It is another object of the present invention to provide a generally improved two speed fuel injection pump governor.

Other objects, together with the foregoing, are attained in the embodiment described in the following description and illustrated in the accompanying drawings.

DESCRIPTION OF THE PREFERRED EMBODIMENT

While the fuel injection pump governor of the invention is susceptible of numerous physical embodiments, depending upon the environment and requirements of use, substantial numbers of the herein shown and described embodiment have been made, tested and used, and all have performed in an eminently satisfactory manner.

Figure 1:
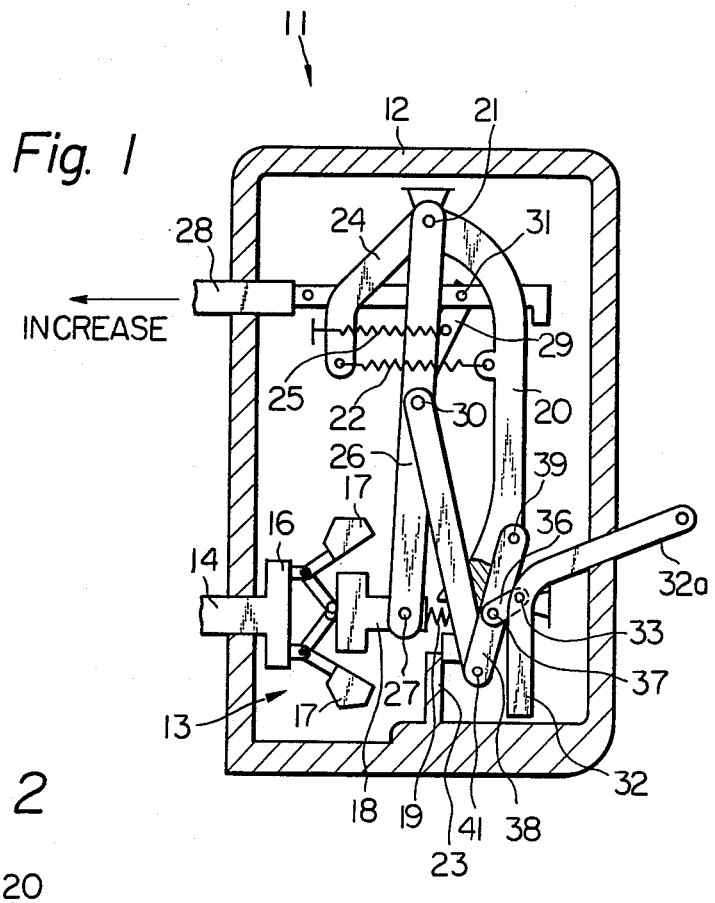
FIG. 1 is a partial side elevation of a governor according to the present invention.

Referring now to FIG. 1, a two-speed fuel injection pump governor for an internal combustion engine such as the compression ignition type (not shown) is generally designated as 11 and comprises a housing 12. A flyweight assembly 13 comprises a shaft 14 which is connected for rotation with, for example, a camshaft of a fuel injection pump (not shown) which is driven from the engine. The rotational speed of the shaft 14 is therefore proportional to the rotational speed of the engine crankshaft, or the engine speed. A support disc 16 is integrally formed with the shaft 14 and pivotally supports flyweights 17 which are urged outwardly by centrifugal force upon rotation of the shaft 14. The inner ends of the flyweights 17 bear against a shifter rod 18 which is urged leftwardly toward a minimum speed position by a compression type low speed governor or idling spring 19.

A tension arm 20 is pivotally supported about a shaft 21 and is urged clockwise by a tension type high speed governor spring 22 into abutment with a stop 23. The idling spring 19 is retained in a preloaded state between the tension arm 20 and the shifter rod 18. The governor spring 22 is connected at its opposite ends to the tension arm 20 and to a fixed bracket 24. Although the governor 11 is shown and described herein as being a two-speed governor with a fixed maximum speed, the bracket 24 may be adapted to be movable to vary the preload of the governor spring 22 and thereby the maximum speed.

Figure 2:
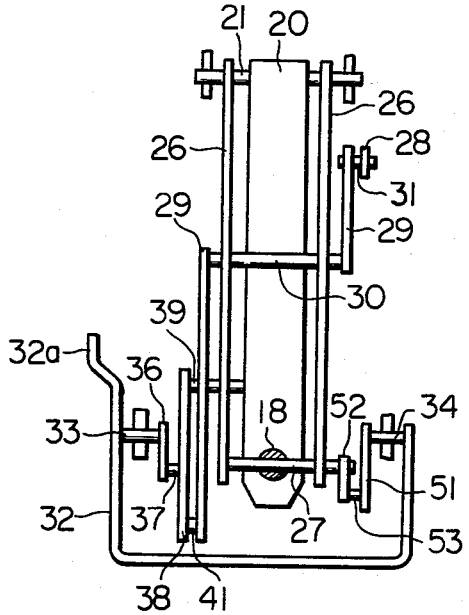
FIG. 2 is a front elevation of the governor.

Referring also to FIG. 2, a guide lever 26 is formed in two sections which are pivotally supported by the shaft 21 on opposite sides of the tension arm 20, the sections being designated by the same reference numeral since they operate in an integral manner. The lower ends of the sections of the guide lever 26 are pivotally connected to the shifter rod 18 by an elongated pin 27.

The governor 11 further comprises a fuel control rod 28 which is axially movable to control the amount of fuel injection into the engine, and may be operably connected to the fuel injection pump in any known manner to accomplish this function. Maximum fuel injection occurs when the fuel control rod 28 is moved to its maximum leftward limit position. A floating lever 29 is pivotally supported by the guide lever 26 by means of an elongated pin 30 and is pivotally connected to the fuel control rod 28 by a pin 31. The floating lever 29 is urged counterclockwise by a starting spring 25.

A generally U-shaped speed control member 32 is pivotally supported by the housing 12 about coaxial fixed shafts 33 and 34. One end of the speed control member 32 is extended to constitute a speed control handle 32*a* which may be connected by means of a suitable linkage to an accelerator pedal (not shown). An arm 36 is integrally pivotal with the speed control member 32 about the shaft 33 and is pivotally connected by means of a pin 37 to a connecting lever 38 which is pivotally supported at its upper end by an elongated pin 39. The connecting lever 38 is pivotally connected to the lower end of the floating lever 29 by a pin 41.

If the governor 11 consisted of only the components described thus far it would operate in a conventional manner which will be described with reference to FIG. 4. The abscissa represents the engine speed and the ordinate represents the amount of fuel injection or analogously the position of the fuel control rod 28.

During operation between a minimum or idling speed N1 and a maximum speed N2 the flyweights 17 develop sufficient centrifugal force to overcome the preload of the idling spring 19 and move the shifter rod 18 into abutment with the lower end of the tension lever 20. The centrifugal force of the flyweights 17 is, however, insufficient to overcome the preload of the governor spring 22. In the speed range between N1 and N2 the engine speed is determined by the position of the speed control member 32 and the engine load. In FIG. 1, counterclockwise rotation of the speed control member 32 toward a maximum speed demand position causes the connecting lever 38 to pivot counterclockwise about the pin 39 which in turn causes the floating lever 29 to pivot counterclockwise about the elongated pin 30. This moves the fuel control rod 28 leftwardly to increase the amount of fuel injection and thereby the engine speed. Clockwise rotation of the speed control member 32 similarly decreases the amount of fuel injection and the engine speed.

When the engine speed drops below N1 more fuel must be injected into the engine to increase the engine speed to N1 and thereby prevent stalling. This function is provided by the idling spring 19. With the engine speed below N1 the flyweights 17 develop insufficient centrifugal force to overcome the force of the idling spring 19 and the shifter rod 18 is moved leftwardly by the idling spring 19 causing the guide lever 26 to pivot clockwise about the shaft 21. This in turn causes the floating lever 29 to pivot counterclockwise about the pin 41 and move the fuel control rod 28 leftwardly to increase the amount of fuel injection. It will be seen in any of the four curves of FIG. 4 that at engine speeds below N1 the fuel injection amount is increased.

When the engine speed exceeds N2 the centrifugal force of the flyweights 17 is sufficient to overcome the preload of the governor spring 22 and the force of the flyweights 17 transmitted through the shifter rod 18 causes the guide lever 26 and the tension arm 20 to pivot counterclockwise about the pin 21 as a unit against the force of the governor spring 22. This counterclockwise movement of the guide lever 26 causes the floating lever 29 to pivot clockwise about the pin 41 and move the fuel control rod 28 rightwardly to reduce the amount of fuel injection and thereby the engine speed. This reduction in fuel injection amount is seen in any of the curves of FIG. 4.

Figure 4:
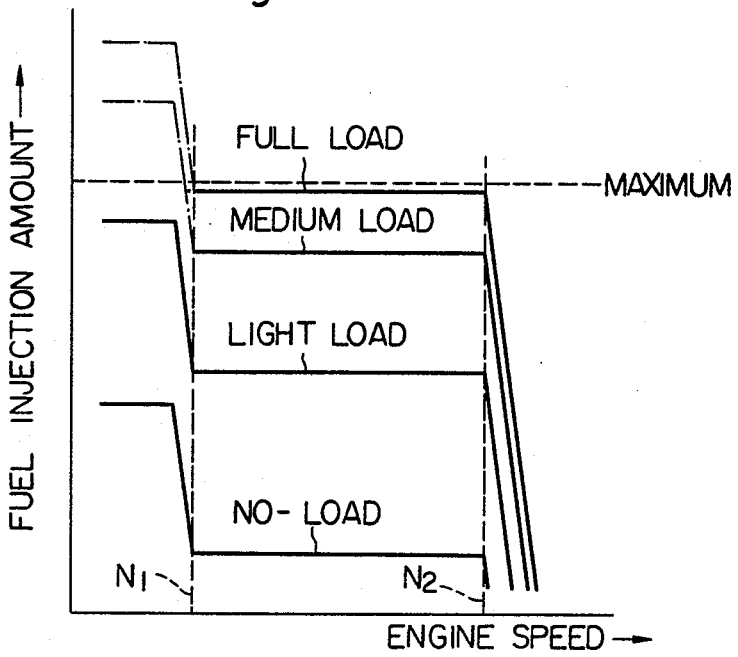
Fig. 4 PRIOR ART
FIG. 4 is a graph illustrating the operation of a prior art governor.

The no-load curve of FIG. 4 illustrates the operation of the governor 11 described thus far with the speed control member 32 in its maximum clockwise position. Similarly, the fuel load curve is obtained with the speed control member 32 in its maximum counterclockwise position. The light and medium load curves are obtained with the speed control member 32 in corresponding intermediate positions. It will be noted that the shape of all of the curves is identical and that movement of the speed control member 32 serves merely to shift the curves vertically. This is because the operation of the flyweights 17 and springs 19 and 22 is a function only of engine speed. The upper portions of the medium and full load curves are shown in phantom line above a maximum fuel injection level since movement of the fuel control rod 28 beyond this limit is not achieved in practice.

The drawback of this prior art arrangement is that the low speed (below N1) regulation operation is the same for no-load and light load operation and that an excessive amount of fuel is injected into the engine during low-speed regulation under light and medium-light load conditions.

Figure 3:
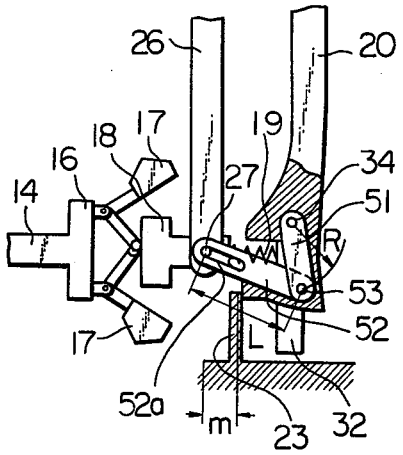
FIG. 3 is a fragmentary view of a novel linkage of the governor.

In order to overcome this drawback, the present governor 11 comprises in addition to the components already described means for progressively limiting the amount of fuel injection during low-speed regulation as the engine load is increased, thereby preventing excessive fuel injection and incomplete combustion. As shown in FIGS. 2 and 3, an arm 51 is integrally connected to the speed control member 32 by means of the shaft 34. A link 52 is pivotally connected to the end of the arm 51 by means of a pin 53 and is formed with a longitudinal slot 52*a*. The elongated pin 27 is extended rightwardly of the rightmost section of the guide lever 26 as viewed in FIG. 2 and is slidably retained in the slot 52*a* of the link 52.

Figure 5:
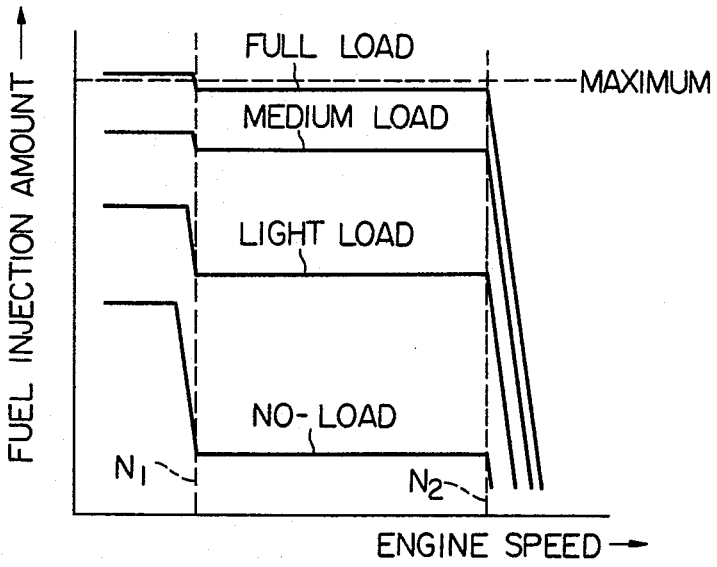
FIG. 5 is similar to FIG. 4 but illustrates the operation of the governor according to the present invention.

As shown in FIG. 3, the engine is operating under no-load conditions with the engine speed below N1 and the speed control member 32 is in its maximum clockwise position. The arm 51 and link 52 also assume their maximum clockwise positions and the guide lever 26 is allowed to be moved clockwise by the idling spring 19 to a maximum extent so that the no-load curves of FIGS. 4 and 5 are substantially identical. The link 52 has substantially no effect under no-load conditions so that the required large amount of fuel may be injected into the engine during low speed regulation.

However, as the speed control member 32 is rotated counterclockwise to compensate for an increase in load, the arm 51 is rotated counterclockwise integrally therewith and the guide lever 26 is pivoted counterclockwise by means of the link 52 and the pin 27. With the speed control member 32 in the full-load or maximum counterclockwise position the pin 27 is moved rightwardly in FIG. 3 by a distance m so that the shifter rod 18 almost abuts against the tension arm 20.

With the speed control member 32 in the full-load position and the engine speed between N1 and N2, the shifter rod 18 is in abutment with the tension arm 20 due to the centrifugal force of the flyweights 17. If, under these conditions, the engine load should increase so that the engine speed drops below N1, the shifter rod 18 will be moved leftwardly by the idling spring 19 as described above. However, this movement is limited to a very small amount by the link 52 which is in its maximum rightward position. As seen from the full load curve of FIG. 5, the increase in fuel injection amount during low speed regulation under full load is very small compared to the increase under no-load conditions. Since the link 52 is moved rightwardly in FIG. 3 as the speed control member 32 is rotated counterclockwise to increase engine speed or compensate for increased load, the increase in the amount of fuel injection is progressively decreased by such rotation of the speed control member 32 by the correct amount to provide a sufficient increase in fuel injection to accomplish low speed regulation under no-load conditions and to limit said increase and thereby prevent incomplete combustion as the load is increased. It is seen in FIG. 5 that the amount of fuel injection increase during low-speed regulation below engine speed N1 progressively decreases as the curve is shifted upwardly due to counterclockwise movement of the speed control member 32 in contrast to FIG. 4 in which the amount of fuel injection increase is constant for all engine loads.

The purpose of the slot 52*a* in the link 52 is to allow the guide lever 26 to move rightwardly along with the tension arm 29 to accomplish high speed regulation (above engine speed N2).

In summary, it will be seen that the objects of the present invention are accomplished since the present governor positively overcomes the problem of excessive fuel injection during low-speed regulation when the engine is operating under load through the embodiment of a simple but novel linkage arrangement. The amount of limitation of fuel injection increase can be adjusted to any required degree through selection of the length R of the arms 51 and the distance L between the pin 53 and the end of the slot 52*a* of the link 52. Other linkage members may be incorporated if desired. Many other modifications within the scope of the invention will become possible for those skilled in the art after receiving the teachings of the present disclosure.

What is claimed is:

1. In a two-speed fuel injection pump governor for an engine, comprising flyweight means rotated at a speed proportional to the engine speed, a speed control member for controlling the speed of the engine, and limiting linkage means operatively connecting the speed control member to the flyweight means to progressively limit movement of the flyweight means in a fuel injection increasing direction as the speed control member is moved toward a maximum speed demand position such that the amount of fuel injection increase during low speed regulation is reduced in proportion to the engine load.

2. A governor as in claim 1, in which the limiting linkage means comprises a link pivotally connected to the speed control member and being formed with a longitudnal slot and a pin fixed to the flyweight means and being slidably received in the slot of the link.

3. A governor as in claim 2, further comprising an arm fixed to the speed control member, the link being pivotally connected to the arm.

4. A governor as in claim 3, further comprising a fixed shaft, the speed control member and the arm being pivotally supported by the shaft.

5. A governor as in claim 1, further comprising a fuel control member and operable linkage means connecting the speed control member and the flyweight means to the fuel control member.

6. A governor as in claim 5, in which the operable linkage means comprises a guide lever pivotal about a fixed fulcrum and being pivotally connected to the flyweight means and a floating lever pivotally supported by the guide lever and being operatively connected to the speed control member and the fuel control member.

7. A governor as in claim 1, in which the flyweight means comprises a high speed governor spring and a low speed governor spring.

8. A governor as in claim 1, in which the limiting linkage means limits movement of the flyweight means toward the minimum speed position to a position furthest from the minimum speed position when the speed control member is in a maximum speed demand position.

9. A fuel injection pump governor for use with an engine comprising:

a fuel control member movable between minimum and maximum values to control fuel to the engine;

a speed control member for controlling the speed of the engine;

flyweight means rotated at a speed proportional to the engine speed;

operable linkage means operatively connecting the speed control member and the flyweight means to the fuel control member such that the speed control member is operable to move the fuel control member between minimum and maximum values while the flyweight means is operable to limit the speed of the engine to a maximum value; and limiting linkage means operatively connected between the speed control member and the flyweight means to progressively limit movement of the flyweight means in a fuel injection increasing direction as the speed control member is moved toward a maximum speed demand position such that the amount of fuel injection increase during low speed regulation is reduced in proportion to the engine load.

10. A fuel injection pump governor according to claim 9 wherein the flyweight means comprises a shifter rod, a pivotally mounted tension arm, a high speed governor spring biasing the tension lever in one pivotal direction, and a low speed governor spring disposed between the shifter rod and the tension arm.

11. A fuel injection pump governor according to claim 10 wherein the operable linkage means comprises a pivotally mounted guide lever, a floating lever pivotally carried by the guide lever, the floating lever being operably connected to and pivotally movable by the speed control member, the flyweight means comprising a shifter rod, a pivot pin pivotally connecting the shifter rod and the guide lever, the limiting linkage means extending between the pivot pin and the speed control member.

12. A fuel injection pump governor according to claim 11 wherein the limiting linkage means comprises a link pivotally connected to the speed control member and being formed with a longitudinal slot, the pivot pin being carried in the slot.

* * * * *